US006176246B1

(12) United States Patent
Lin et al.

(10) Patent No.: US 6,176,246 B1
(45) Date of Patent: Jan. 23, 2001

(54) MULTIPLE-FOLD AUTOMATIC UMBRELLA WITH SIMPLIFIED STRUCTURE AND SHORTENED LENGTH

(75) Inventors: Chung-Kuang Lin; Jung-Jen Chang, both of Taipei Hsien (TW)

(73) Assignee: Fu Tai Umbrella Works, Ltd., Taipei Hsien (TW)

( * ) Notice: Under 35 U.S.C. 154(b), the term of this patent shall be extended for 0 days.

(21) Appl. No.: 09/282,198

(22) Filed: Mar. 31, 1999

(51) Int. Cl.[7] ..... A45B 25/14; A45B 25/16

(52) U.S. Cl. ..... 135/24; 135/22; 135/23; 135/25.1

(58) Field of Search ..... 135/22, 23, 24, 135/25.1

(56) References Cited

U.S. PATENT DOCUMENTS 5,868,151 * 2/1999 Kuo ..... 135/24
5,992,433 * 2/1999 Chung-Kuang et al. ..... 135/24
6,016,822 * 1/2000 Lin et al. ..... 135/24

* cited by examiner

*Primary Examiner*—Robert Canfield
(74) *Attorney, Agent, or Firm*—Dougherty & Troxell

(57) ABSTRACT

A multiple-fold automatic umbrella includes: a central shaft consisting of plural tubes telescopically engageable with one another; a rib assembly including at least a top rib pivotally secured to an upper notch of the central shaft, a stretcher rib pivotally secured between the top rib and a lower runner slidably held on the central shaft, and other ribs pivotally connected with one another and pivotally secured to the top rib and the stretcher rib; an opening spring resiliently retained in the central shaft for opening the umbrella; a plurality of closing springs for closing the umbrella; and a control device including a drawer shaped push button slidably held in a grip of the central shaft having an upper latch integrally formed on the push button operatively disengaging the lower runner for opening the umbrella, and a lower latch for closing the umbrella when opened and perpendicularly secured under the lower latch with a safety spring member resiliently held in a front chamber formed in a front portion of the grip, not in a bottom portion of the grip, in order for shortening the length of the grip for miniaturizing the multiple-fold automatic umbrella.

12 Claims, 7 Drawing Sheets

MULTIPLE-FOLD AUTOMATIC UMBRELLA WITH SIMPLIFIED STRUCTURE AND SHORTENED LENGTH

BACKGROUND OF THE INVENTION

U.S. Pat. No. 5,626,161 issued to the same inventors of this application disclosed an automatic umbrella having triple folds for folding the umbrella ribs and the tubes of the central shaft. While the U.S. patent application of Ser. No. 09/071,439 filed on May 1, 1998 by the same inventors of this application disclosed an automatic umbrella with quadruple folds. Both the two prior arts as above-mentioned disclosed an anti-false operation safety means 57 having an elongated cylinder (571) which is operatively lowered by the tubes of the central shaft (1) after closing the umbrella to lower the latch (54) integrally formed on the cylinder (571) to prevent a false depression of the push button (51) against the latch (54) of the closing controller (53) when opening the umbrella.

Since the elongate cylinder (571) of the anti-false operation safety means (57) should be provided in a lower portion of the grip (12) and the lower tube (11) of the central shaft (1), it will require an appreciable length of the grip and the shaft, thereby influencing a total length of the umbrella when folded and limiting the miniaturization of the multiple-fold automatic umbrella.

The present inventor has found the drawbacks of the conventional automatic umbrella and invented the present automatic umbrella with simplified structure and also with shortened length.

SUMMARY OF THE INVENTION

The object of the present invention is to provide a multiple-fold automatic umbrella including: a central shaft consisting of plural tubes telescopically engageable with one another; a rib assembly including at least a top rib pivotally secured to an upper notch of the central shaft, a stretcher rib pivotally secured between the top rib and a lower runner slidably held on the central shaft, and other ribs pivotally connected with one another and pivotally secured to the top rib and the stretcher rib; an opening spring resiliently retained in the central shaft for opening the umbrella; a plurality of closing springs for closing the umbrella; and a control device including a drawer shaped push button slidably held in a grip of the central shaft having an upper latch integrally formed on the push button operatively disengaging the lower runner for opening the umbrella, and a lower latch for closing the umbrella when opened and perpendicularly secured thereunder with a safety spring member resiliently held in a front chamber formed in a front portion of the grip, not in a bottom portion of the grip, in order for shortening the length of the grip for miniaturizing the multiple-fold automatic umbrella.

BRIEF DESCRIPTION OF THE BRIEF DRAWINGS

FIG. 1 illustration showing an opened umbrella of the present invention.

FIG. 2 shows an umbrella when closed from FIG. 1.

FIG. 3 a sectional drawing of the grip portion of the present invention as partially enlarged from FIG. 1.

DETAILED DESCRIPTION

Figure 1:
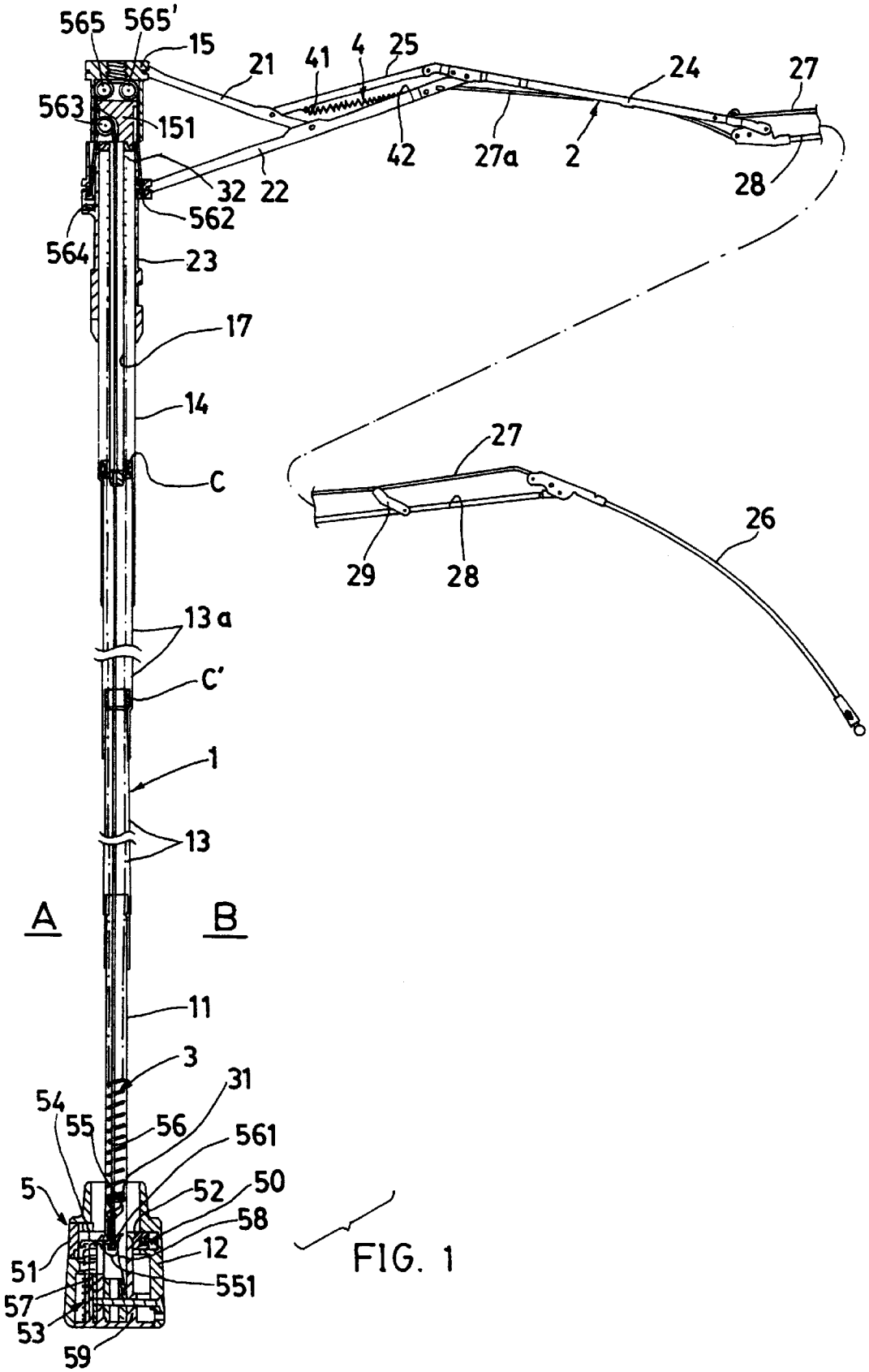

As shown in FIGS. 1–17, the present invention comprises: a central shaft 1, a rib assembly 2, an opening spring 3, a plurality of closing springs 4, and a control means 5. The central shaft 1 includes: a lower tube 11, a grip 12 secured to a lower tube portion 111 of the lower tube 11, a first middle tube 13 slidably held on an outer and upper side of the lower tube 11, a second middle tube 13*a* slidably held on an outer and upper side of the first middle tube 13, an upper tube 14 slidably held on an outer and upper side of the second middle tube 13*a,* an upper notch 15 secured on a top portion of the upper tube 14, and a central sleeve 17 secured to an inner block 15 fixed in the top portion of the upper tube 14.

Figure 22:
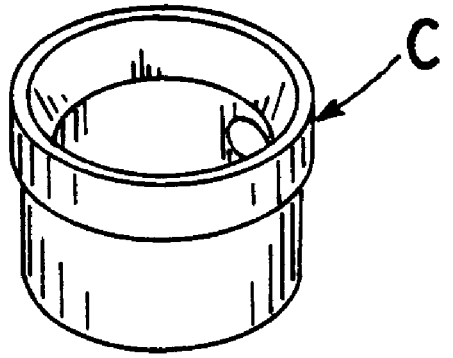
FIG. 22 shows a collar retained on a tube end of the central shaft for smoothly guiding the opening spring within the tube walls of the central shaft.
Figure 23:
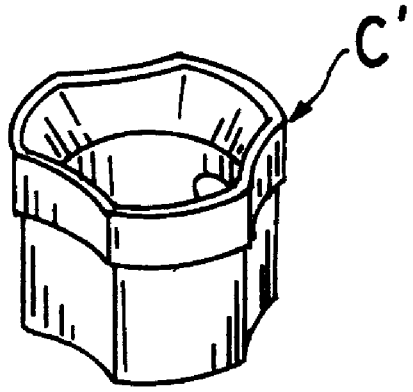
FIG. 23 shows another collar as modified from FIG. 22.

Collars C, C' (FIGS. 22, 23) are each retained on an upper tube end of the middle tubes 13, 13*a* for smoothly guiding the opening spring 3 to be slidably held in the tubes of the central shaft 1 for a smooth and silent opening or closing operation of the umbrella.

The rib assembly 2 includes: a top rib 21 having an inner portion of the top rib 21 pivotally secured to the upper notch 15 of the central shaft 1, a stretcher rib 22 having a middle rib portion connected with an outermost end of the top rib 21 and having an inner portion of the stretcher rib 22 pivotally secured to a lower runner 23 which is slidably held on the upper tube 14 and having an outermost rib end of the stretcher rib 22 pivotally connected with an inner portion of a middle rib 24, the middle rib 24 having an innermost end of the middle rib 24 pivotally connected with an outer end of an inner connecting rib 25, having an inner end of the inner connecting rib 25 connected with an outer portion of the top rib 21, a tail rib 26 having an innermost end of the tail rib 26 pivotally connected with an outer end of an outer spring rib 27 with the outer spring rib 27 having an inner end thereof pivotally connected with an outer portion of the middle rib 24, an inner spring rib 27*a* juxtapositionally held to the middle rib 24 and connected between an innermost end of an outer connecting rib 28 and an outer portion of the stretcher rib 22, the outer connecting rib 28 juxtapositionally coupled with the outer spring rib 27 by a coupling 29, having an inner portion of the outer connecting rib 28 pivotally connected with an outermost end of the middle rib 24 and having an outer end of the outer connecting rib 28 pivotally connected to an inner portion of the tail rib 26.

Other mechanisms of the ribs can be modified. The lower runner 23 has a lower extension tube 230 protruding downwardly from the runner 23 having an engaging hole 231 cut in a rear side of the extension tube 230, and having a depression portion 232 recessed in a bottom portion on the front side of the extension tube 230.

The cross sectional shapes of the tubes of the central shaft 1 are not limited in the present invention.

Every two neighboring tubes may be formed with a coupling or limiting means therebetween for preventing separation or escape of the tubes when opening the umbrella and extending the tubes of the central shaft 1. The number of folds of the present invention is not limited, which can be triple or quadruple folds or the like.

The opening spring 3 for opening an umbrella of this invention has a lower spring end 31 retained on a lower portion of the lower tube 11, and an upper spring end 32 retained on a bottom portion of the inner block 151 inserted in an upper portion of the upper tube 14, the opening spring 3 slidably disposed about the central sleeve 17.

Each closing spring 4 of the plurality of the closing springs 4 has an inner spring end 41 of the closing spring 4 secured to an inner portion of the inner connecting rib 25, and an outer spring end 42 of the closing spring 4 secured to an outer portion of the stretcher rib 22. The closing spring 4 is provided for closing the umbrella from its opened state by an elastic energy stored when opening the umbrella. The closing spring 4 may also be installed on the other locations of the rib assembly 2.

Figure 6:
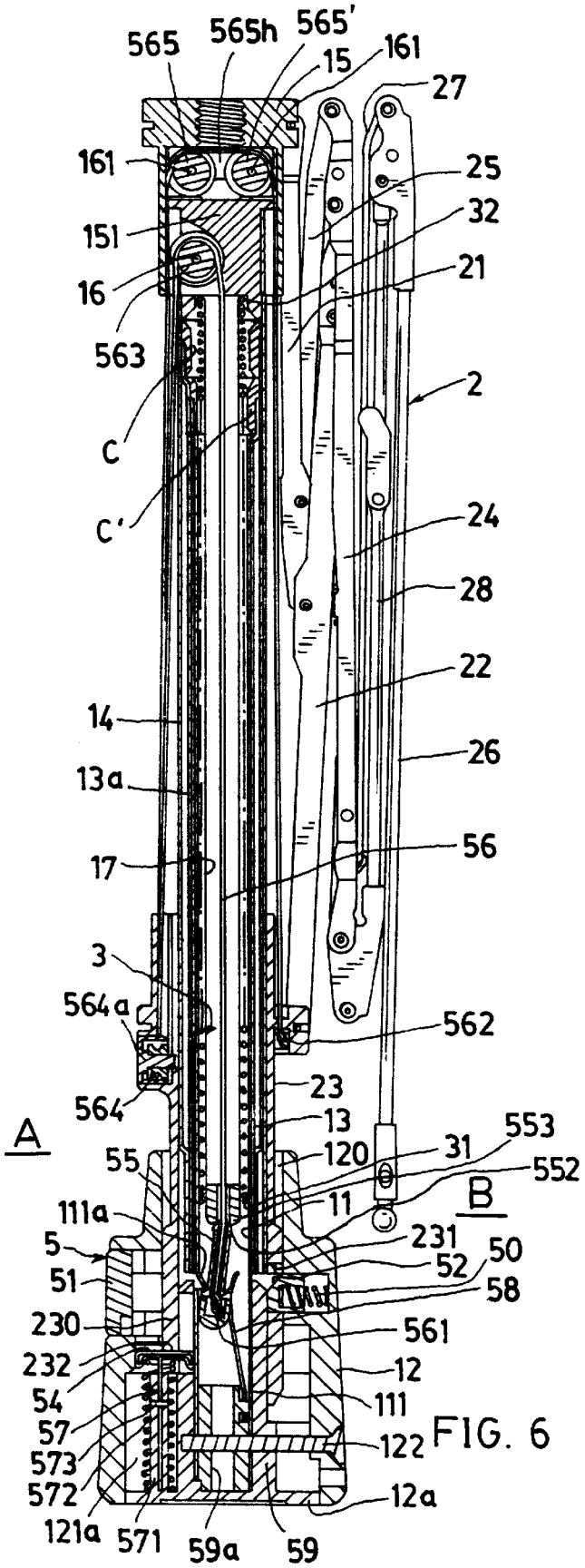
FIG. 6 is a sectional drawing when compressing the opening spring in FIG. 2 for resetting the present invention as folded.
Figure 7:
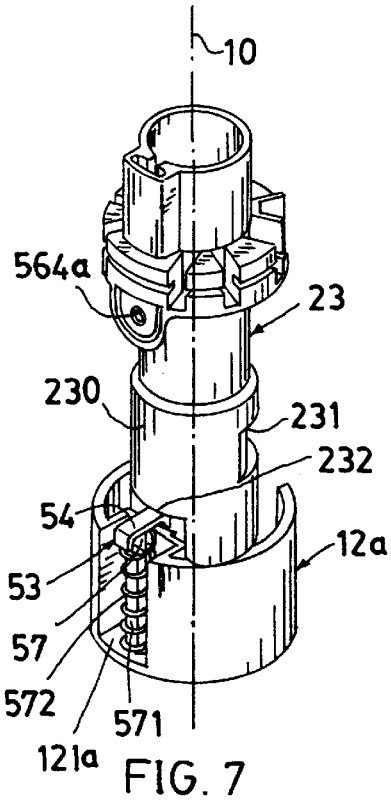
FIG. 7 is a perspective view showing the lowering of the lower runner to depress the closing controller of this invention.
Figure 8:
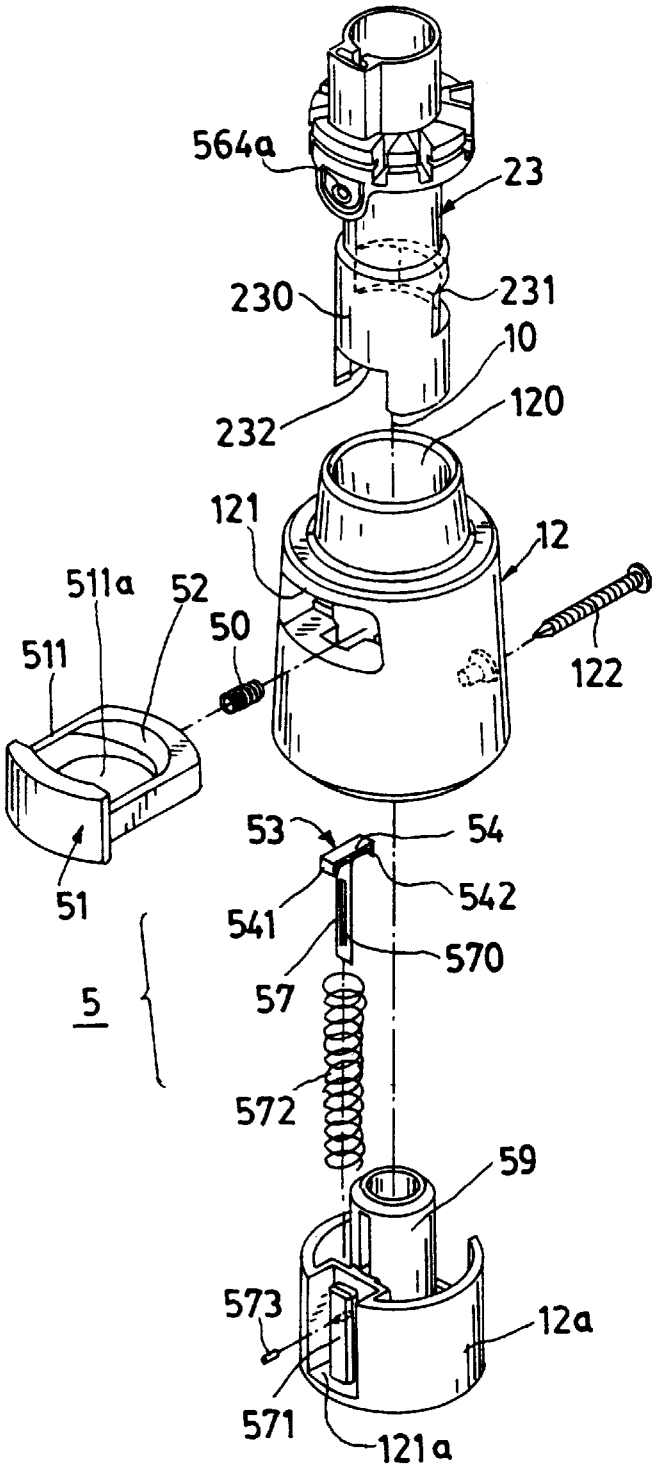
FIG. 8 is an exploded view showing the elements of the grip, the control means and the lower runner of the present invention.

The control means 5 includes: a drawer-shaped push button 51 integrally formed with a ring portion 511 slidably held in a button hole 121 formed in the grip 12 having an upper latch 52 integrally formed on a rear portion of the ring portion 511 with the ring portion defining a central hole 511*a* for passing the extension tube 230 of the lower runner 23 when closing the umbrella and with the upper latch 52 tapered downwardly centripetally towards a center of the central hole 511*a* from a rear side B of the central shaft 1 towards a front side A of the shaft 1, with the upper latch 52 resiliently urged, by a restoring spring 50 retained in the grip at the rear side B of the shaft 1, towards the front side A of the shaft 1 for engaging the engaging hole 231 formed in the extension tube 230 of the runner when closing the umbrella, and upon depression of the push button to simultaneously retract the upper latch 52 to disengage the runner for opening the umbrella; a closing controller 53 having a lower latch 54 perpendicularly secured with a safety spring member 57 under the lower latch 54, with the safety spring member 57 resiliently held in a front chamber 121*a* formed in a lower front portion of the grip 12 and the lower latch 54 resiliently urged upwardly between the push button 51 and the locking head 551 to be operatively depressed by the push button 51 for inwardly pushing the locking head 551 of a locking head means 55, which is secured with a drag rope 56 repeatedly linked among an upper portion of the upper tube 14, a plurality of guiding rollers and the lower runner 23, for disengaging the locking head 551 from a detent protrusion 111*a* formed in a lower portion 111 of the lower tube 11, thereby allowing each said closing spring 4 to be restored to release its pre-stored elastic energy for closing an opened umbrella; with the lower latch 54 and the safety spring member 57 operatively lowered by the lower extension tube 230 of runner 23, after closing the umbrella and compressing the opening spring 3, to be positioned under the button 51 to prevent a false depression of the closing controller 53 by the push button when opening the umbrella as shown in FIG. 6. The push button 51 has a width larger than a diameter of the lower extension tube 230 of the runner 23 for an ergonomic depression of the button.

The detent protrusion 111*a* is directly punched inwardly from a lower portion of the lower tube 11 for engaging the locking head 551 when closing the umbrella and compressing the spring 3 as being sidewardly biased towards the first side A of the shaft 1 by a convex spring plate 58 formed in the grip 12 at the second side B of shaft 1 (FIG. 6).

As shown in FIGS. 3–6, 7 and 8, the grip 12 is longitudinally formed with a central hole 12 therein having a button hole 121 transversely formed in the grip 12 for slidably holding the push button 51 in the button hole 121; and a base 12*a* having a bottom sleeve 59 protruding upwardly from a central portion of the base 12*a* to be engaged with a lower tube portion of the lower tube 11, with the base 12*a* embedded and engaged with a bottom portion of the grip 12, whereby upon an insertion of a screw 122 through the grip 12, the base 12*a* and the lower tube 11, a combination thereof will be formed. The "front chamber" (121*a*) is defined in a front portion of the base 12*a* and the grip 12 (before the lower portion of the lower tube 11) for storing the safety spring member 57 within the front chamber 121*a*.

Figure 2:
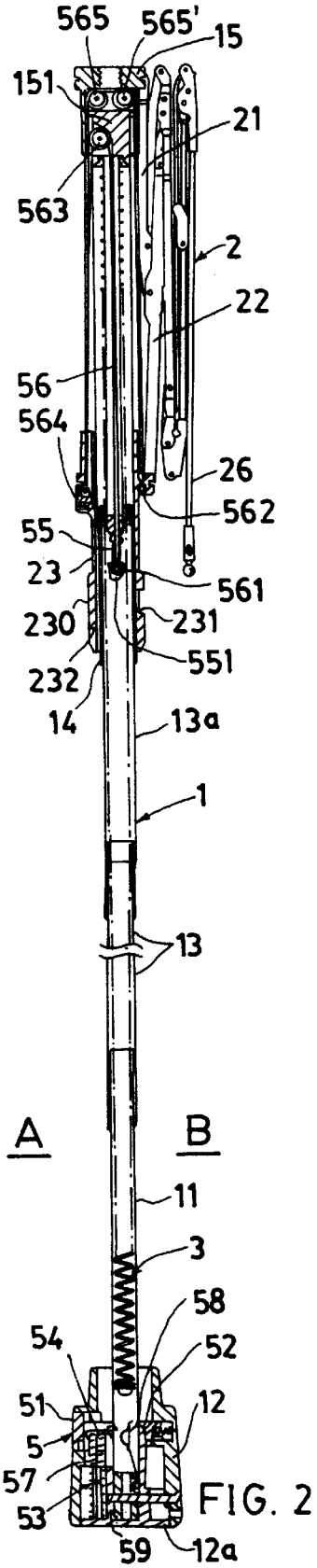
Figure 3:
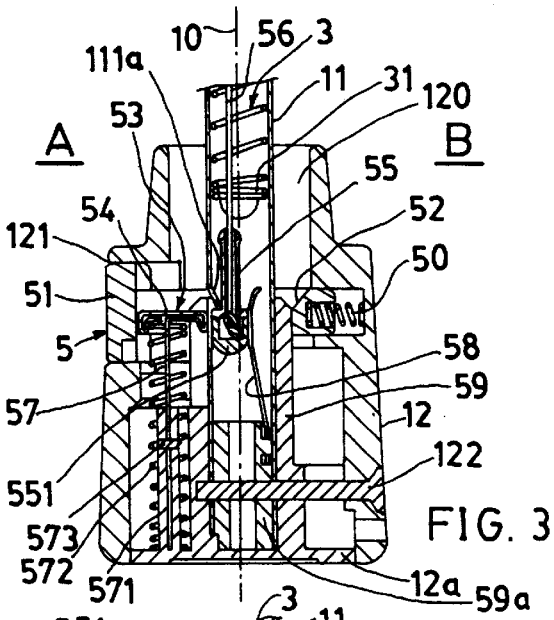

The lower latch 54 includes an outer depressing end 541 contacted with the push button 51 when the umbrella is opened and an inner thrusting end 542 facing the locking head 551 engaged on the detent protrusion 111*a* of the lower tube 11; having the safety spring member 57 perpendicularly secured to a central bottom portion of the lower latch 54, and resiliently urged upwardly by a tension spring 572 retained in the front chamber 121*a* in the grip 12 to normally position the lower latch 54 between the push button 51 and the locking head 551 as shown in FIGS. 1, 3, whereby upon a depression of the push button 51 to inwardly depress the lower latch 54 and the locking head 551, the locking head 551 will be disengaged from the protrusion 11*a* to close the umbrella from FIG. 1 to FIG. 2. While upon a lowering of the lower runner 23, when compressing the opening spring 3 for resetting the closed umbrella as shown in FIG. 6, the lower extension tube 230 of the runner 23 will depress the lower latch 54 downwardly to leave from the button 51 and locking head 551. The depression portion 232 recessed in a bottom of the extension tube 230 will depress the lower latch 54 and will be engaged with a side wall of the front chamber 121*a* (FIG. 7) for preventing a rightward or leftward vibration of the runner 23 and for stabilizing of the runner 23 when closing the umbrella.

Figure 4:
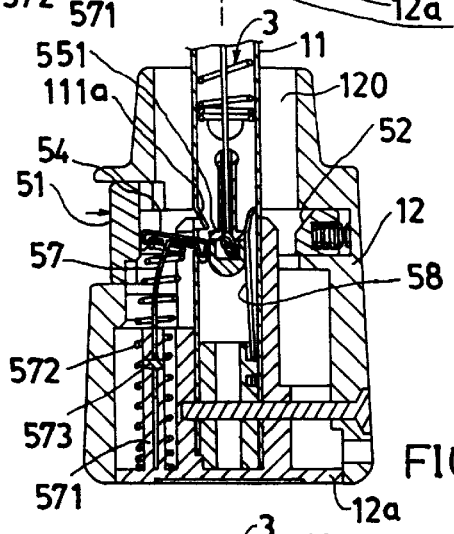
FIG. 4 is a sectional drawing when depressing the push button from FIG. 3.
Figure 5:
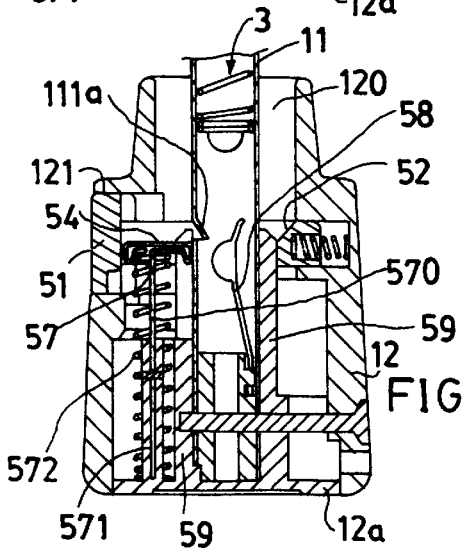
FIG. 5 is a sectional drawing when restored from FIG. 4.

The safety spring member 57 is slidably engageable in a guiding sleeve 571 erected in the front chamber 121*a* in the grip 12, having an elongate slot 570 longitudinally formed through the spring member 57 and slidably engageable with a stopper or stopping pin 573 fixed on the guiding sleeve 571 and the tension spring 572 disposed around the safety spring member 57 and the guiding sleeve 571 to allow an upper spring end of the tension spring 572 to urge the lower latch 57 secured to an upper end of the safety spring member 57 to be positioned in between the push button 51 and the locking head 551, with the spring member 57 upwardly limited by the stopper 573 (FIGS. 3, 5), ready for a depression by the push button 51 to disengage the locking head 551 when closing the umbrella; and upon releasing of the button 51 after closing the umbrella, the safety spring member 57 will be automatically restored as shown from FIG. 4 to FIG. 5.

As shown in FIGS. 18–21, the closing controller 53 may be further modified, in which the safety spring member 57, as perpendicularly secured to the lower latch 54, includes a guiding plunger 571*a* formed on a lower portion of the safety spring member 57, having a cavity recessed in a bottom of the plunger 571*a* for retaining the tension spring 572 in the cavity of the plunger 571*a*, with the tension spring 572 held in the front chamber 121*a* defined in a front portion of the grip before (not "under") the lower portion of the lower tube 11 to normally urge the spring member 57 and lower latch 54 upwardly, whereby upon depression of the push button 51 to inwardly depress the lower latch 54 as urged by the spring member 57 (FIG. 20) and the locking head 551 through a lower hole in the lower tube 11, the locking head 551 will be disengaged from the protrusion 111*a* for closing the umbrella (FIG. 20 to FIG. 21), with the plunger 571*a* upwardly limited by the stopper or diaphragm stopper 573 formed on an upper portion of the front chamber 121*a* in the grip 12.

After releasing the depression of the push button 51, the safety spring member 57 will be automatically restored to be vertically straightened. The guiding punger 571*a* is slidably engageable in the front chamber 121*a* in the grip 12 for a stable upward or downward movement within the chamber 121*a* like a piston or plunger sliding in a piston cylinder, thereby stabilizing the sliding movement of the plunger 571*a* and the safety spring member 57 in the front chamber 121*a*. Upon lowering of the lower runner 23 when closing the umbrella (FIG. 19), the depression portion 232 as recessed in a bottom of the runner 23 will depress the lower latch 54 secured on the safety spring member 57 downwardly and the depression portion 232 will be engaged with the diaphragm 573 (FIG. 18) on an upper portion of the front chamber 121*a* for preventing a twisting of the lower runner 23 when the umbrella is closed.

Figure 12:
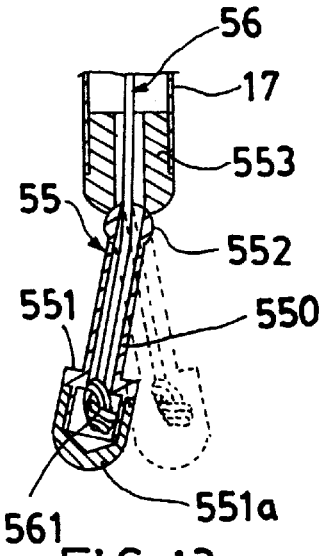
FIG. 12 shows a relationship of the locking head means and the relevant elements of this invention.
Figure 13:
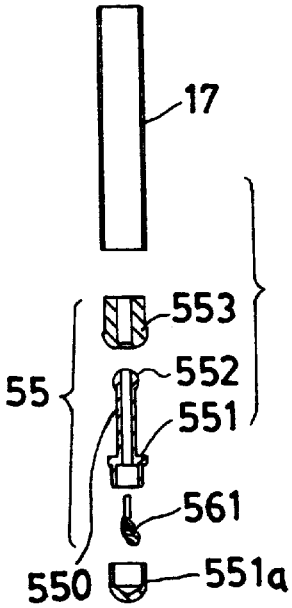
FIG. 13 is an exploded view of the elements of FIG. 12.
Figure 14:
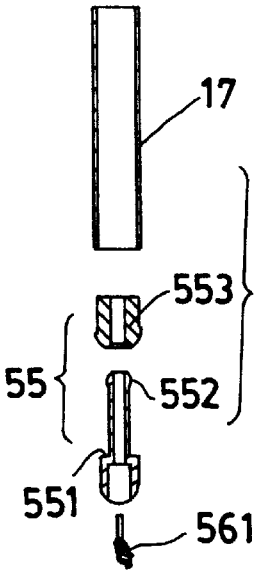
FIG. 14 shows another modification of FIG. 12.

The locking head means 55 as shown in FIGS. 12, 13 includes: the locking head 551 formed on a lower end of a hollow stem 550 of the locking head means 55 for storing a lower rope end 561 of the rope 56 which is tied to be a knot in the locking head 551, a spherical or arcuate cover 551*a* capped on a bottom end of the locking head 551, an upper spherical portion 552 formed on an upper end of the hollow stem 550, and a spherical or arcuate bottom plug 553 embedded in a bottom end of the central sleeve 17 to be universally engageable with the upper spherical portion 552 of the hollow stem 550 when closing the umbrella by engaging the locking head 551 on the protrusion 111*a* of the lower tube 11 (FIG. 6). As shown in FIG. 14, the cover 551*a* of FIG. 13 is omitted, and the locking head 551 should still be formed with a spherical bottom portion on the bottom of the head 551.

The drag rope 56 includes: a lower rope end 561 secured to the locking head 551 of the locking head means 55, an upper rope end 562 fixed to the lower runner 23, an upper guiding roller 563 rotatably mounted by an upper pivot 16 in the inner block 151 secured in an upper portion of the upper tube 14 for slidably guiding the drag rope 56 from inside the upper tube 14 and the central sleeve 17 for winding the rope on the upper guiding roller 563 with the rope then directed downwardly towards the lower runner 23 to be wound on a lower guiding roller 564 rotatably mounted on the lower runner 23 by a lower pivot 564*a*, an uppermost guiding roller means rotatably mounted on a top portion of the upper tube 14 and positioned above the upper roller 563 for further winding the rope 56 on the uppermost guiding roller means from the lower guiding roller 564, with the upper rope end 562 downwardly directed to be fixed to the lower runner 23 opposite to the lower guiding roller 564. So, the rope 56 is first wound on the upper roller 563 from the inside of the shaft 1 and guided to the lower roller 564 on the runner 23 by winding the rope on the lower guiding roller 564 and then defectively extended upwardly to be wound on the uppermost roller means and finally deflected downwardly to be fixed to the lower runner 23, thereby providing an enough stroke for the rope for quadruple or multiple folds of an automatic umbrella.

Figure 15:
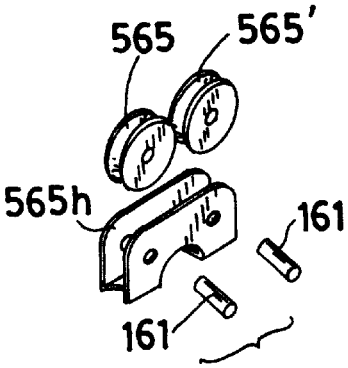
FIG. 15 is a perspective view of two uppermost guiding rollers and their engaging holder.
Figure 16:
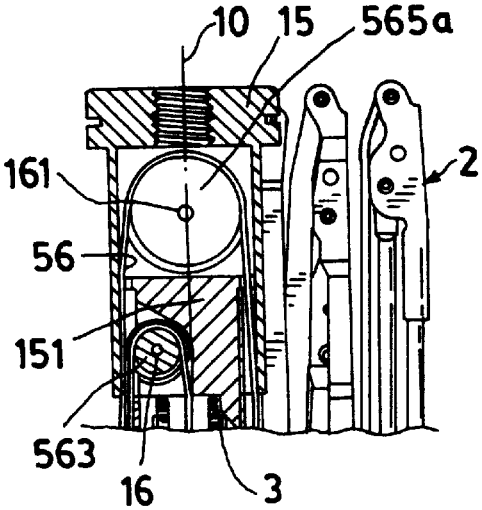
FIG. 16 is a sectional drawing showing another modification of the uppermost guiding roller.

The uppermost guiding roller means as shown in FIGS. 6, 15, 16 includes: a pair of uppermost guiding rollers 565, 565' respectively rotatably mounted in opposite portions of an upper portion of the inner block 151 by two uppermost pivots 161 above the upper guiding roller 563 for winding the rope 56 on the two uppermost guiding rollers 565, 565' for disposing the rope 56 on opposite outer surfaces of the upper tube 14 for dynamically balancing the rope stroke when operating the umbrella.

Figure 17:
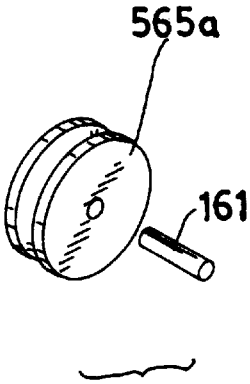
FIG. 17 is a perspective view of the large uppermost guiding roller as shown in FIG. 16.
Figure 18:
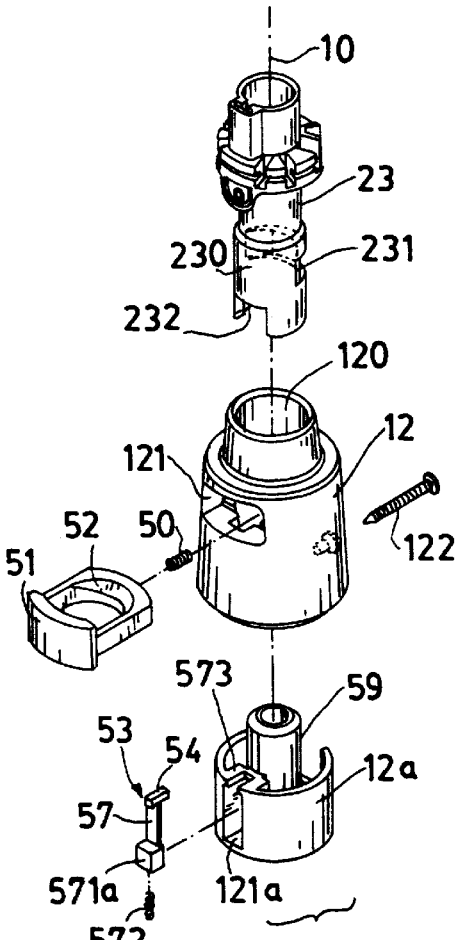
FIG. 18 is an exploded view of the control means of another preferred embodiment of the present invention.
Figure 19:
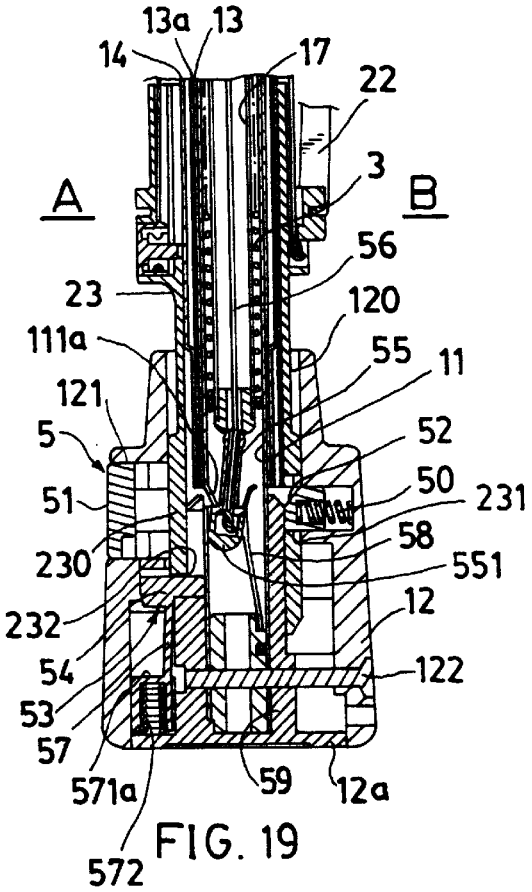
FIG. 19 is a partial sectional drawing of a closed umbrella by using the elements of FIG. 18.
Figure 20:
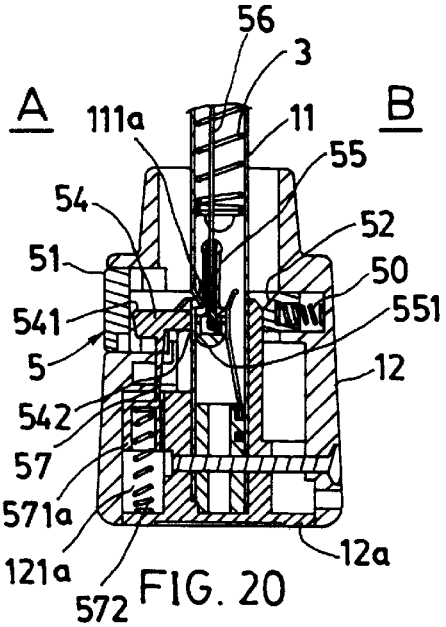
FIG. 20 is a partial sectional drawing of the present invention when opened from FIG. 19.
Figure 21:
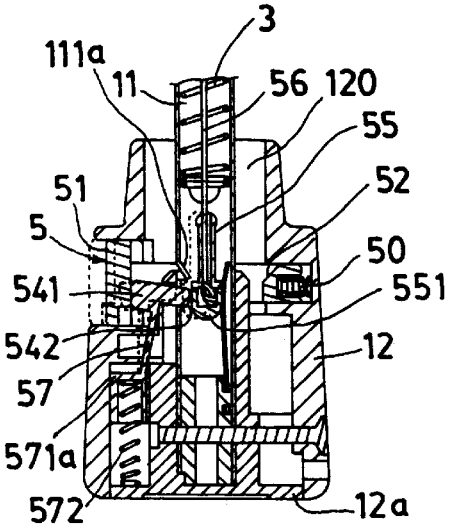
FIG. 21 shows a depression of the push button for closing the umbrella from FIG. 20.

The uppermost guiding roller means may be modified to be an uppermost guiding wheel 565*a* as shown in FIGS. 16, 17 in which the uppermost guiding wheel 565*a* has a diameter generally equal to a diameter of the upper tube 14 and rotatably mounted on the top of the upper tube 14 by an uppermost pivot 161 transversely secured on the top of the upper tube 14 and generally perpendicularly intersecting a longitudinal axis 10 of the shaft 1 for symmetrically disposing an outer rope section of the rope 56 on opposite sides of the pivot 161 and disposed on opposite outer surfaces of the upper tube 14 for dynamic balancing of the rope stroke when folding and unfolding the umbrella.

As shown in FIG. 15, the two uppermost guiding rollers 565, 565' are respectively rotatably mounted on a U-shaped roller holder 565*h* embedded in a top portion of the upper tube 14.

Figure 9:
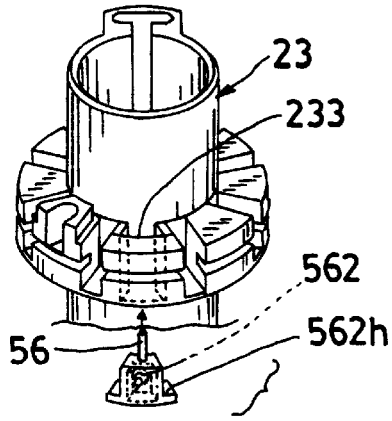
FIG. 9 shows an installation relationship of an upper rope end with the lower runner of the present invention.
Figure 10:
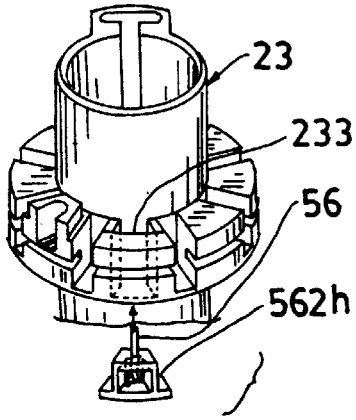
FIG. 10 shows a modification from FIG. 9.
Figure 11:
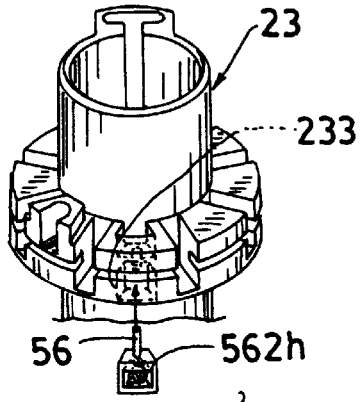
FIG. 11 shows a further modification of FIG. 9.

As show in FIGS. 9–11, the upper rope end 562 of the drag rope 56 is secured in a rope holder 562*h* which is formed as T shape or D shape and embedded in a cavity 233 recessed in a ferrule of the lower runner 23.

When opening the umbrella of the present invention from FIG. 6 to FIG. 1, the push button 51 is depressed to retract the upper latch 52 to disengage the latch 52 from the hole 231 of the lower runner 23, the opening spring 3 will urge the lower runner 23 and the tubes of the central shaft 1 upwardly and extend the ribs of the rib assembly 2 for opening the umbrella.

When closing the umbrella, the push button 51 is depressed to inwardly thrust the lower latch 54 and the locking head 551 to disengage the head 551 from the protrusion 111*a* on the tube 11, the closing springs 4 will retract the ribs, lower the runner 23 and fold the tubes of the central shaft 1 from FIG. 1 to FIG. 2 for closing the umbrella. Then, the opening spring 3 is compressed for resetting the closed umbrella as shown in FIG. 6 for storing the elastic energy of the spring 3 for next opening use.

When closing the umbrella as shown in FIG. 6, the lower latch 54 and the safety spring member 57 are depressed and lowered downwardly without contacting with the push button 51 and the locking head 551 in order for preventing a depression of the push button for unlocking the head 551 from the protrusion 111*a* since the latch 54 has been lowered to be under the button 51, thereby preventing a false operation for actuation of the closing controller 53 when opening the umbrella.

The present invention is superior to the conventional multiple-fold automatic umbrella with the following advantages:

1. The safety spring member 57 is resiliently held in a front chamber 121*a* in the front portion of the grip 12 before (not "under") the lower tube portion of the lower tube 11, thereby shortening the length of the umbrella for a better miniaturization of a foldable umbrella.
2. The lower latch 54 has an outer contacting end 541 normally contacting the push button 51, and an inner thrusting end 542 facing or corresponding to the locking head 551, thereby gravitationally balanced on and disposed on opposite sides of the safety spring member 57 for a stable positioning and smooth operation of the latch 54 and the safety spring member 57.
3. The push button 51 is integrally formed with the upper latch 52 and is formed as a "drawer" smoothly slidable in the grip 12 for a convenient opening operation of the umbrella.
4. The elements of the grip 12 and control means 5 are made to be module units for an easier assembly, operation and maintenance. For instance, the base 12*a* is embedded in a bottom of the grip 12 for quicker assembly of the relevant elements within the grip.
5. The structure of the umbrella has been greatly simplified for decreasing the production cost and the length has also been shortened for a convenient handling and storage.

The present invention may be modified without departing from the spirit and scope of the present invention.

What is claimed is:

1. A multiple-fold automatic umbrella comprising:

a central shaft including: a lower tube having a grip secured therewith, at least a middle tube slidably held on said lower tube, and an upper tube slidably held on the middle tube having an upper notch fixed on a top of the upper tube;

a rib assembly including at least a top rib pivotally secured to the upper notch, a stretcher rib pivotally connected to the top rib and a lower runner slidably held on the upper tube, a middle rib pivotally connectable to said stretcher rib and said top rib, and a tail rib pivotally connected to the middle rib; with the lower runner having a lower extension tube protruding downwardly from said runner;

an opening spring resiliently retained in said central shaft for opening the umbrella;

a plurality of closing springs resiliently retained on said rib assembly for closing the umbrella; and a control means including a push button formed as a drawer shape slidably held in said grip and integrally formed with a ring portion having an upper latch integrally formed on a rear portion of the ring portion tapered downwardly and centripetally towards a enter of the ring portion defining a central hole in the ring portion for passing the lower extension tube of the lower runner when closing the umbrella to engage the upper latch with an engaging hole formed in the lower extension tube of said runner, whereby upon depression of said push button to disengage said upper latch from said lower runner, the umbrella will be opened;

a closing controller including a lower latch having a safety spring member perpendicularly secured to said lower latch and resiliently held in a front chamber defined in a front portion of said grip before a lower tube portion of the lower tube of the central shaft; a locking head means secured with a drag rope continuously defectively wound on a plurality of guiding rollers respectively rotatably mounted on the shaft and on said runner; with said lower latch resiliently urged to be positioned between said push button and a locking head of said locking head means when opening the umbrella, whereby upon depression of the push button to thrust the lower latch to disengage the locking head from a detent protrusion on said lower tube, the umbrella will be closed from an opened state; and upon compression of said opening spring and folding the tubes of the central shaft when closing the umbrella, the lower latch will be downwardly depressed by the lower runner to be positioned under the push button for preventing a false operation of said lower latch.

2. An automatic umbrella according to claim 1, wherein said grip is transversely formed with a button hole in the grip for slidably holding said push button in said button hole; and formed with a central hole longitudinally through the grip for combinably embedding a base in a bottom portion of the central hole of the grip having a bottom sleeve protruding upwardly from said base to engage a lower tube portion of the lower tube of the central shaft; said front chamber defined in a front portion of said base and said grip for storing said safety spring member in said front chamber; either a width of said push button or an inside diameter of said central hole in said ring portion of said button being larger than a diameter of said lower extension tube.

3. An automatic umbrella according to claim 1, wherein said lower latch includes an outer depressing end contacting with said push button and an inner thrusting end facing said locking head engaged on said protrusion formed on said lower tube; said lower latch having a central bottom portion thereof perpendicularly secured to an upper end of said safety spring member; whereby upon an inward depression of said push button and said lower latch, said locking head will be thrusted to disengage from the protrusion for closing an opened umbrella.

4. An automatic umbrella according to claim 3, wherein said safety spring member is slidably held in a guiding sleeve formed in said front chamber in said grip, having a tension spring disposed around said guiding sleeve and said safety spring member for resiliently urging said lower latch upwardly to be positioned between said push button and said locking head ready for a depression of said push button for closing an opened umbrella; said safety spring member having an elongate slot longitudinally formed through said safety spring member and slidably engageable with a stopper or limiting pin fixed on said guiding sleeve, with said stopper limiting an upward movement of said safety spring member.

5. An automatic umbrella according to claim 3, wherein said safety spring member has a guiding plunger formed on a lower end of said safety spring member, said guiding plunger slidably engageable with said front chamber in said grip having a tension spring retained in said front chamber and retained into a cavity recessed in a bottom of said guiding plunger for resiliently urging said safety spring member and said lower latch upwardly to be depressible by the push button when the umbrella is opened; with said guiding plunger upwardly limited by a stopper or diaphragm formed on an upper portion of said front chamber; and upon closing of the umbrella for lowering said lower extension tube of said runner, a depression portion recessed in a bottom of said lower extension tube of said runner will depress the lower latch downwardly and will be operatively engageable with said diaphragm of said front chamber for preventing twisting of said runner when closing the umbrella.

6. An automatic umbrella according to claim 1, wherein said locking head means includes a hollow stem having its lower end formed with said locking head for storing a lower rope end of said drag rope therein, said locking head having a bottom portion selected from a spherical bottom portion and a bottom portion capped with a spherical bottom cover on said bottom portion of said locking head; said hollow stem having its upper end formed as a spherical portion to be universally engageable with a spherical plug inserted in a bottom portion of a central sleeve secured in said upper tube of said central shaft; and said drag rope upwardly extendible from said locking head for passing through said hollow stem and said central sleeve.

7. An automatic umbrella according to claim 1, wherein said drag rope includes: a lower rope end secured to the locking head means, an upper rope end fixed to the lower runner, an upper guiding roller rotatably mounted in an upper portion of the upper tube for slidably guiding the drag rope from inside the upper tube and a central sleeve for winding the rope on the upper guiding roller, a lower guiding roller rotatably mounted on the lower runner for winding the rope as guided from said upper guiding roller, an uppermost guiding roller means rotatably mounted on a top portion of the upper tube and positioned above the upper roller for further winding the rope on the uppermost guiding roller means from the lower guiding roller, with the upper rope end downwardly directed to be fixed to the lower runner opposite to said lower guiding roller.

8. An automatic umbrella according to claim 7, wherein said uppermost guiding means includes a pair of uppermost guiding rollers respectively rotatably mounted in opposite portions of an inner block by two uppermost pivots and positioned above the upper guiding roller for winding the rope on the two uppermost guiding rollers for disposing the rope on opposite outer surfaces of the central shaft for dynamically balancing the rope when operating the umbrella.

9. An automatic umbrella according to claim 7, wherein said uppermost guiding means is an uppermost guiding wheel having a diameter generally equal to a diameter of the central shaft and rotatably mounted on a top of the shaft by an uppermost pivot transversely secured on the top of the shaft means and generally perpendicularly intersecting a longitudinal axis of the shaft for symmetrically disposing an outer rope section of the drag rope on opposite sides of the uppermost guiding wheel and disposed on opposite outer surfaces of the shaft for dynamic balancing of a rope when folding and unfolding the umbrella.

10. An automatic umbrella according to claim 8, wherein said two uppermost guiding rollers are rotatably mounted in a roller holder embedded in a top of said upper tube.

11. An automatic umbrella according to claim 7, wherein said upper rope end of said drag rope is fixed in a rope holder embedded in a cavity recessed in a ferrule of said lower runner.

12. An automatic umbrella according to claim 1, wherein said middle tube includes a collar retained on an upper tube end for smoothly guiding said opening spring within said central shaft.

* * * * *